US007290594B2

(12) United States Patent
Chan

(10) Patent No.: US 7,290,594 B2
(45) Date of Patent: Nov. 6, 2007

(54) INTERCOOLER

(76) Inventor: Sun Chan, 5 Koala Avenue, Ingleburn, New South Wales 2565 (AU)

( * ) Notice: Subject to any disclaimer, the term of this patent is extended or adjusted under 35 U.S.C. 154(b) by 546 days.

(21) Appl. No.: 10/932,689

(22) Filed: Sep. 1, 2004

(65) Prior Publication Data

US 2005/0274502 A1 Dec. 15, 2005

(30) Foreign Application Priority Data

Jun. 15, 2004 (AU) ..... 2004903232

(51) Int. Cl.
*F28F 9/007* (2006.01)

(52) U.S. Cl. ..... 165/67; 165/149

(58) Field of Classification Search ..... 165/67, 165/149; 411/166, 172, 173, 178
See application file for complete search history.

(56) References Cited

U.S. PATENT DOCUMENTS 3,314,138 A * 4/1967 Double ..... 29/432.2
3,348,596 A * 10/1967 Leitner ..... 411/180
3,469,493 A * 9/1969 Fisher ..... 411/71
3,823,526 A * 7/1974 Rose ..... 403/408.1
3,950,910 A * 4/1976 Pobanz ..... 52/783.11
4,540,044 A * 9/1985 Lenz ..... 165/149
4,678,026 A * 7/1987 Lenz et al. ..... 165/67
5,037,259 A * 8/1991 Duran et al. ..... 411/173
5,257,662 A * 11/1993 Osborn ..... 165/173
5,360,059 A * 11/1994 Olson ..... 165/149
5,931,220 A * 8/1999 Ueda et al. ..... 165/67
5,964,767 A * 10/1999 Tapia et al. ..... 606/73
7,040,380 B1 * 5/2006 O'Brien ..... 165/67
2002/0056541 A1 * 5/2002 Kokubunji et al. ..... 165/67

* cited by examiner

*Primary Examiner*—Allen J. Flanigan
(74) *Attorney, Agent, or Firm*—Christie, Parker & Hale, LLP.

(57) ABSTRACT

An intercooler configured for attachment to an automobile is disclosed. One embodiment of the invention includes an intercooler body having an inlet manifold on one end and an outlet manifold on the other end, and a decorative top plate on the top of the intercooler attached to the manifolds. The decorative top plate has two holes in it which are both keyed to resist rotation of an insert, a hollow bolt having a stepped formation under the bolt head such that the stepped formation is able to key in the hole cut in the plate, the bolt is inserted through the top of the plate and secured by a nut secured underneath it so that the head of the bolt lies flush against the plate and the stepped formation keys against the hole to prevent rotation. In addition, the bolt is hollow having a threaded passage passing through it to receive another bolt to secure the intercooler to a bracket in the automobile.

9 Claims, 6 Drawing Sheets

PERSPECTIVE VIEW

FRONT, REAR VIEW

INTERCOOLER

CROSS-REFERENCE TO RELATED APPLICATION

This application claims priority to Australian Application No. 2004903232, filed Jun. 15, 2004, the disclosure of which is incorporated herein by reference.

BACKGROUND OF THE INVENTION

The invention relates generally to intercoolers for automobiles, and more specifically to a technique for securing intercoolers to automobiles. An intercooler is a type of heat exchanger for removing the heat caused by the compression between stages of a compressor. When charging air for use in an internal combustion engine, the air becomes compressed and therefore is heated. Intercoolers cool the charged air prior to entering the combustion chamber of the engine to increase the amount of useful oxygen in a given volume of the intake air and thereby improve the efficiency of the engine.

Intercoolers are often added after purchase by car enthusiasts to increase performance of their car. Typically, installation of an intercooler after purchase of an automobile, requires the installation of fittings and fixtures to both intercooler and engine bay, and can detract from the overall aesthetic appearance of the intercooler and engine bay of the automobile in which the intercooler is installed.

SUMMARY OF THE INVENTION

The invention is an intercooler for an automobile, including an intercooler body having an inlet manifold on one end and an outlet manifold on the other end, and a decorative top plate on the top of the intercooler attached to the manifolds. The decorative top plate has two holes in it which are both keyed to resist rotation of an insert, a hollow bolt having a stepped formation under the bolt head such that the stepped formation is able to key in the hole cut in the plate, the bolt is inserted through the top of the plate and secured by a nut secured underneath it so that the head of the bolt lies flush against the plate and the stepped formation keys against the hole to prevent rotation. In addition, the bolt is hollow having a threaded passage passing through it to receive another bolt to secure the intercooler to a bracket in the automobile.

In one example, the holes and the stepped formations may match each other. The holes in the decorative top plate and the stepped formations under each bolt may have a hexagonal or square shape.

The height of the stepped formation may be equal to, or less than, the thickness of the plate.

The intercooler may comprise a second decorative plate, similar to the first, welded along the underside of the intercooler.

The decorative top plate and hollow bolt may be machined or molded from stainless steel, or any other material of suitable strength.

The intercooler may further include at least one channel with substantially straight fins, wherein the air flow through one of the channels is faster than other areas of the intercooler body. In one embodiment, a channel is located at the top of the intercooler adjacent to the top plate, to force more air from the intercooler body to exit through the outlet manifold.

The ends of the intercooler having the inlet and outlet manifolds are rounded, to reduce the drop in pressure within the intercooler.

BRIEF DESCRIPTION OF THE DRAWINGS

An example of the invention will now be described with reference to the accompanying drawings, in which.

DETAILED DESCRIPTION OF THE INVENTION

Figure 1:
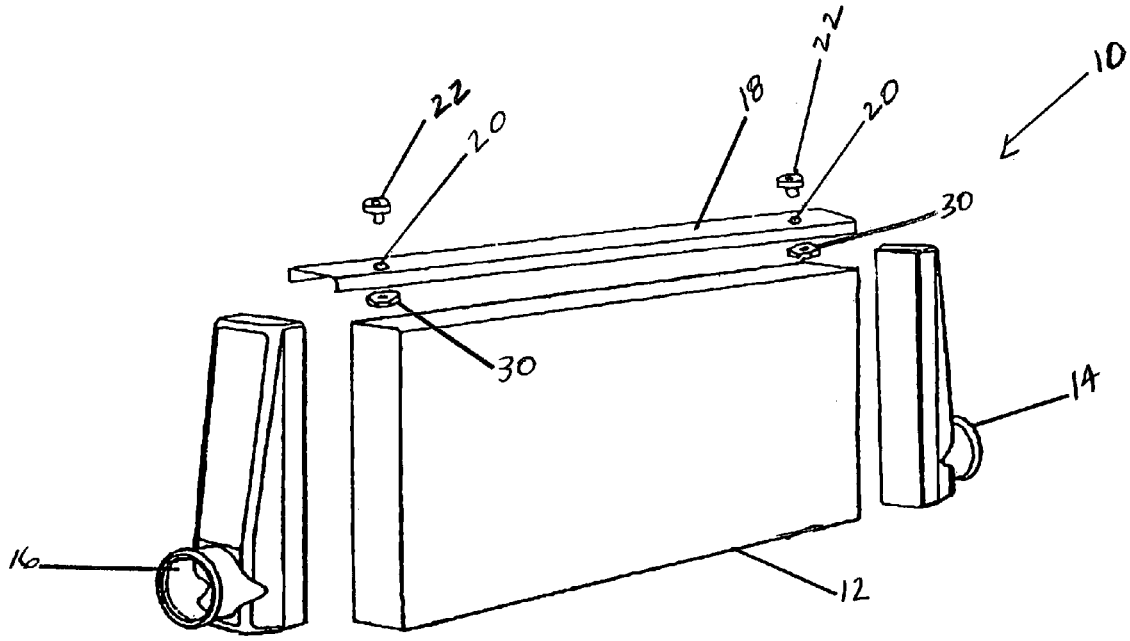
FIG. 1 is an exploded view of an intercooler in accordance with an embodiment of the present invention.

The intercooler 10 illustrated in FIG. 1 has a body 12, an inlet manifold 14 on a first end, an outlet manifold 16 on an opposing end, and a decorative top plate 18 which is welded along the top of the body of the intercooler 10. The decorative top plate 18 has two holes 20 cut through it which are both keyed to 15 resist rotation of a matching insert in the form of a hollow bolt 22. In this example, the holes 20 are of a hexagonal shape and thickness of the plate is two millimeters. In other embodiments, a plate with a different thickness can be used.

Figure 2:
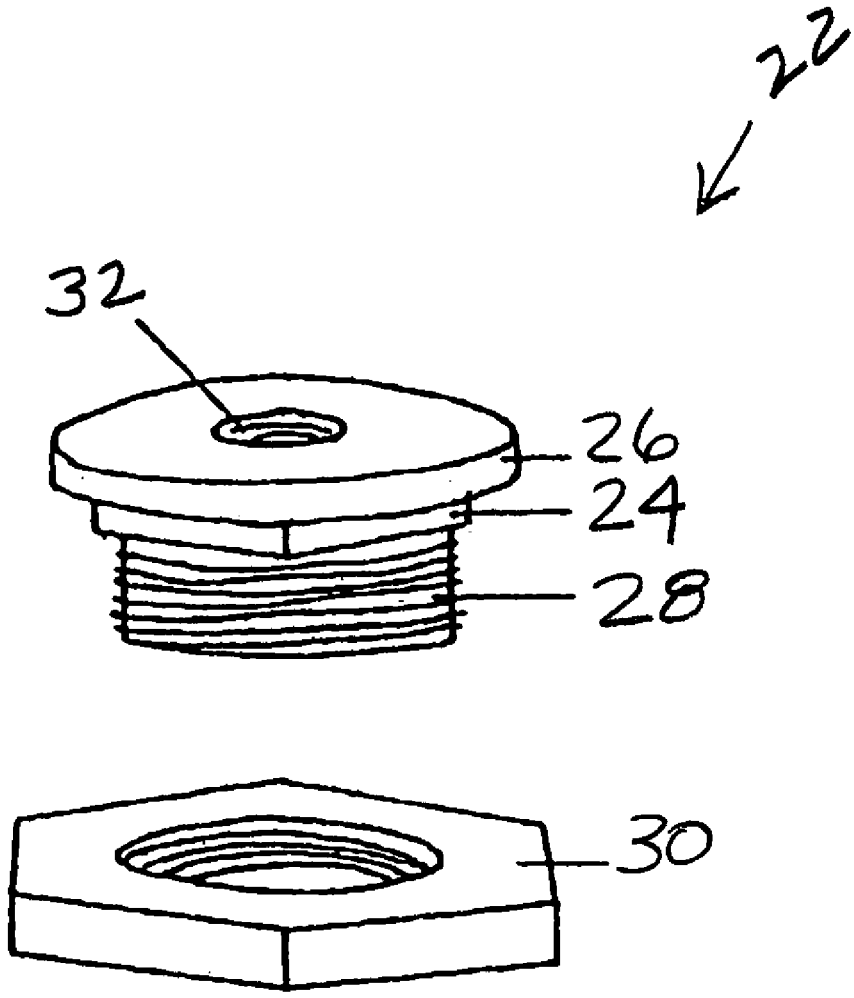
FIG. 2 is an exploded view of a portion of the intercooler in accordance with an embodiment of the present invention.

With further reference to FIG. 2, the hollow bolt 22 has a stepped formation 24 under the bolt head 26. The stepped formation 24 is also hexagonally shaped. The height of the stepped formation 24 is approximately 0.25 mm larger than the thickness of the plate. One of ordinary skill will appreciate that the dimensions of the hollow bolt 22 and the plate 18 can be varied as required for individual embodiments of an intercooler in accordance with the present invention.

The bolt 22 is inserted through the top of the plate 18 and the stepped formation 24 is keyed in the hole 20 cut in the plate 18. The external thread 28 of the bolt 22 is secured by a nut 30 underneath the plate 18 so that the underside of the head 26 of the bolt 22 lies flush against the plate 18 and the stepped formation 24 keys against the hole 20 to prevent rotation.

A second decorative plate (not shown) is provided and welded along the underside of the intercooler 10. The second decorative plate has the same form as that of the first, in that it has two holes cut through it which are both keyed to resist rotation of a matching insert in the form of a hollow bolt.

When mounting the intercooler 10 within an automobile, a pair of attachment bolts pass through respective openings in an upper bracket of the automobile and similarly, a further pair of attachment bolts pass through respective openings in a lower bracket of the automobile. Having passed through the bracket, each attachment bolt is received in an internal threaded passage 32 of the bolt 22.

Advantageously, fitting the decorative top plate 18 over the intercooler body 12 and securing each of the attachment bolts 22 to the bracket results in an aesthetically pleasing appearance. Moreover, the way the intercooler 10 mounts to the brackets of the automobile enable the intercooler 10, if required, to be relatively easily removed.

Figure 3:
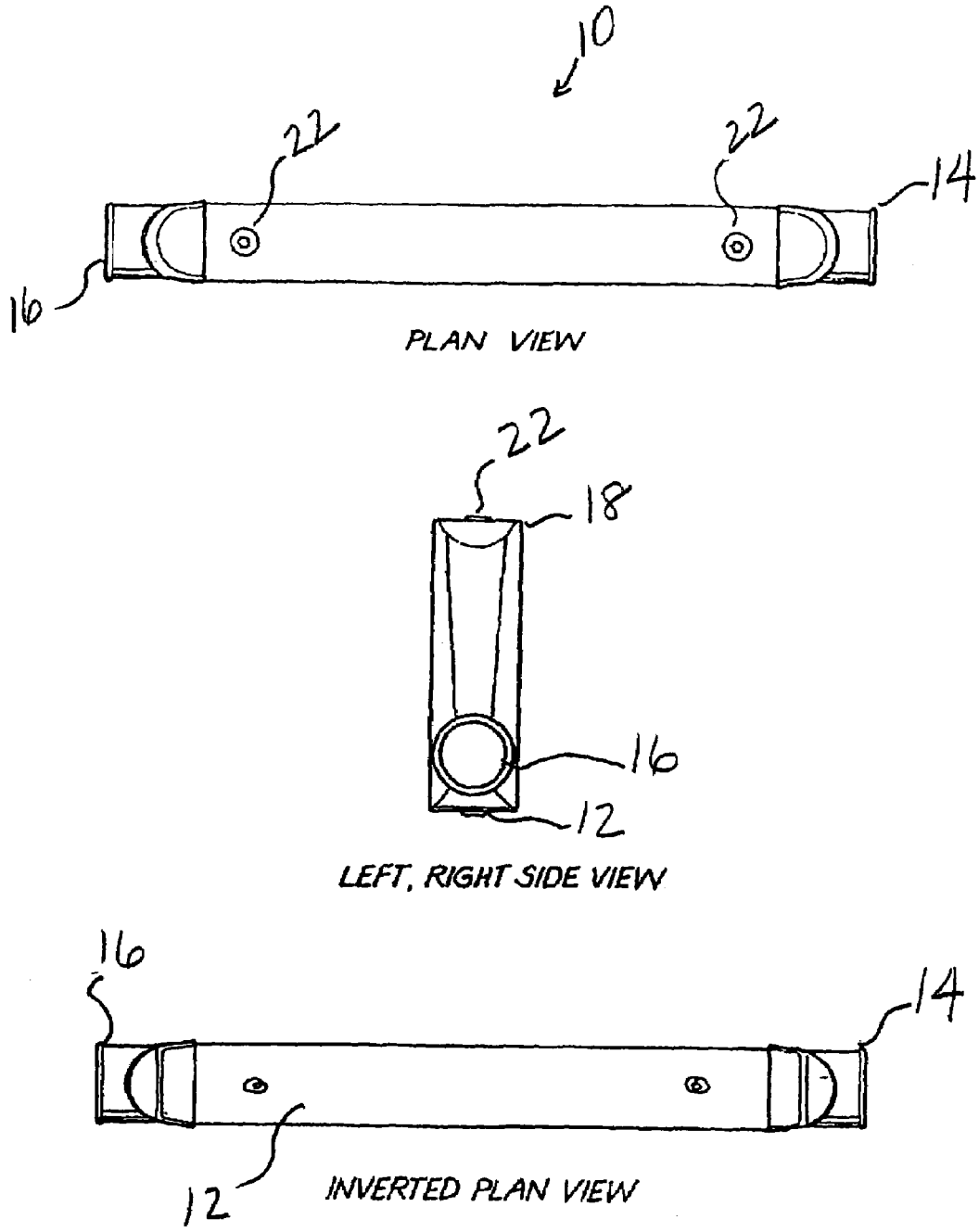
FIG. 3 is a set of views of an intercooler in accordance with an embodiment of the present invention.
Figure 4:
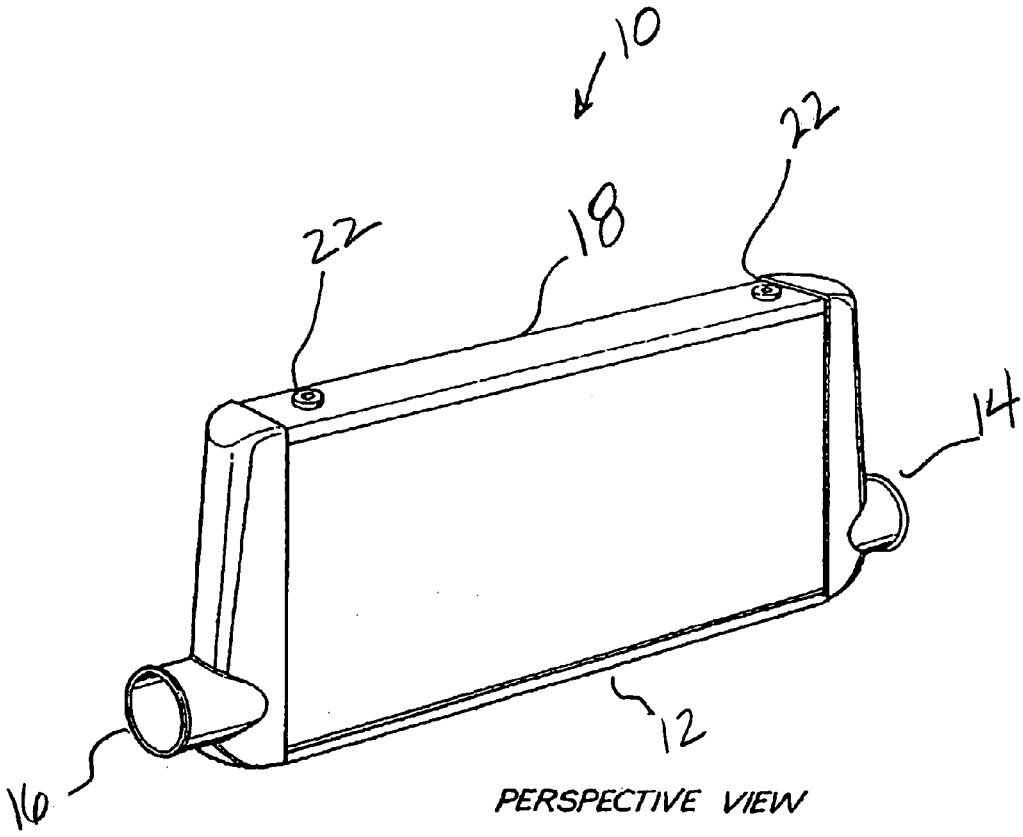
FIG. 4 is a set of views of an intercooler in accordance with an embodiment of the present invention.
Figure 4:
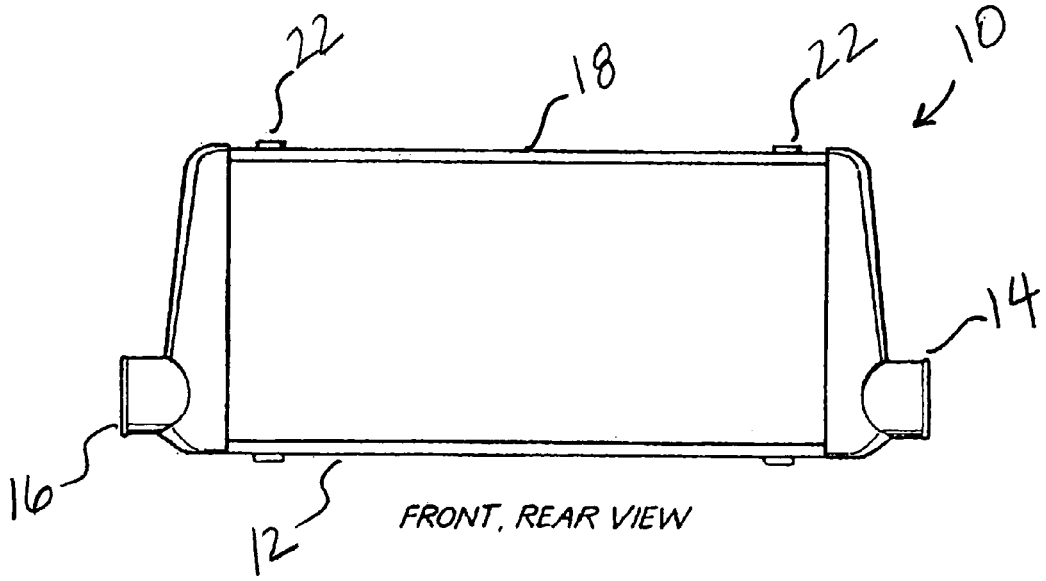
Figure 6:
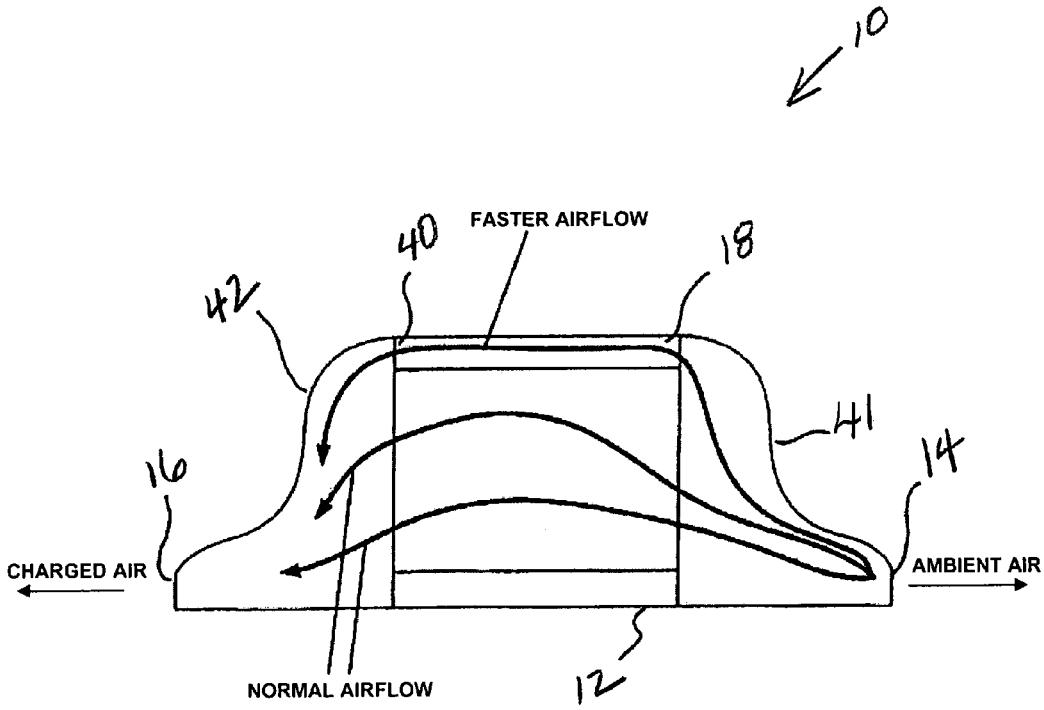
FIG. 6 is a diagram illustrating airflow through the intercooler in accordance with an embodiment of the present invention.

Referring to FIGS. 3, 4 and 6, in another embodiment, preferably two channels 40 are provided having a straight fin design. The other sections of the intercooler body 11 have a cross fin design, also to enable heat exchange of the air. The channels 40 are located at an upper part of the intercooler 10, adjacent to the top plate 18. Air flow near the top plate 18 is increased since there is less restriction on the air traveling via the channels 40. Air flow through the channels 40 is greater than the air flow through the cross fins. The distance traveled by the air through the straight fins is shorter than the distance traveled by the air through the cross fins. This is intended to create an effect similar to the Venturi effect. Increasing air flow at the upper part (distal to the outlet manifold 16) assists in pushing the charged air through the outlet manifold 16 and into the combustion chamber (not shown) of the automobile's engine. Thus, the overall flow rate through the intercooler 10 is increased.

Figure 5:
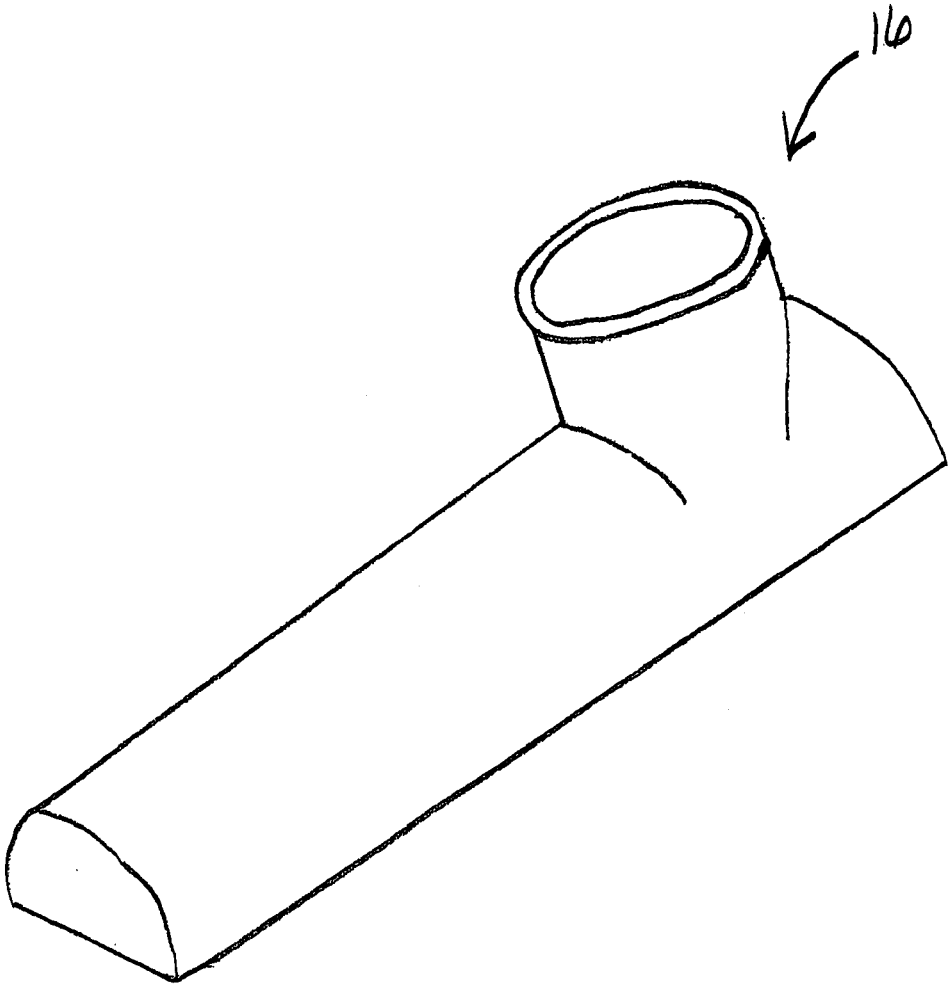
FIG. 5 is a perspective view of an inlet/outlet manifold in accordance with an embodiment of the present invention.

Referring to FIG. 5, rounded tanks 41, 42 are provided at the sides of the intercooler 10 to reduce the build up of high pressure areas. The fluid paths of air entering the intercooler 10 at the inlet manifold 14 and charged air leaving the intercooler 10 the outlet manifold 16 are designed to reduce pressure drop within the tanks 41, 42.

It will be appreciated by persons skilled in the art that numerous variations and/or modifications may he made to the invention as shown in the specific embodiments without departing from the spirit or scope of the invention as broadly described. The present embodiments are, therefore, to be considered in all respects as illustrative and not restrictive.

What is claimed is:

1. An intercooler for an automobile, comprising:

an intercooler body having an inlet manifold on one end and an outlet manifold on the other end;

a decorative top plate on the top of the intercooler attached to the manifolds, the decorative top plate having two holes in it which are both keyed to resist rotation of an insert;

a hollow bolt having a stepped formation under the bolt head such that the stepped formation is able to key in the hole cut in the plate, the bolt is inserted through the top of the plate and secured by a nut secured underneath it so that the head of the bolt lies flush against the plate and the stepped formation keys against the hole to prevent rotation; and wherein the bolt is hollow having a threaded passage passing through it to receive another bolt to secure the intercooler to a bracket in the automobile.

2. The intercooler according to claim 1, wherein the holes and the stepped formations match each other.

3. The intercooler according to claim 1, wherein the holes in the decorative top plate and the stepped formations under each bolt have a hexagonal or square shape.

4. The intercooler according to claim 1, wherein the height of the stepped formation may be equal to, or less than, the thickness of the plate.

5. The intercooler according to claim 1, further comprising a second decorative plate welded along the underside of the intercooler.

6. The intercooler according to claim 1, wherein the decorative top plate and hollow bolt are machined or molded from stainless steel.

7. The intercooler according to claim 1, further comprising at least one channel with substantially straight fins, wherein the air flow through the at least one channel is faster than other areas of the intercooler body.

8. The intercooler according to claim 7, wherein the at least one channel is located at the top of the intercooler adjacent to the top plate, to force more air from the intercooler body to exit through the outlet manifold.

9. The intercooler according to claim 1, wherein the ends of the intercooler having the inlet and outlet manifolds are rounded, to reduce the drop in pressure within the intercooler.

* * * * *